United States Patent [19]

Hiyoshi et al.

[11] 4,166,405

[45] Sep. 4, 1979

[54] ELECTRONIC MUSICAL INSTRUMENT

[75] Inventors: Teruo Hiyoshi; Akira Nakada; Shigeru Yamada, all of Hamamatsu; Kiyoshi Ichikawa, Hamakita; Sigeki Isii, Hamamatsu, all of Japan

[73] Assignee: Nippon Gakki Seizo Kabushiki Kaisha, Hamamatsu, Japan

[21] Appl. No.: 909,838

[22] Filed: May 26, 1978

Related U.S. Application Data

[63] Continuation of Ser. No. 727,789, Sep. 29, 1976, abandoned.

[30] Foreign Application Priority Data

Sep. 29, 1975 [JP] Japan ..... 50-117430

[51] Int. Cl.[2] ..... G10H 1/02

[52] U.S. Cl. ..... 84/1.24; 84/1.03; 84/1.26

[58] Field of Search ..... 84/1.01, 1.03, 1.11, 84/1.17, 1.19, 1.24, 1.25, 1.26

[56] References Cited

U.S. PATENT DOCUMENTS

| | | | |
|---|---|---|---|
| 3,882,751 | 5/1975 | Tomisawa | 84/1.26 |
| 3,908,504 | 9/1975 | Deutsch | 84/1.19 |
| 3,910,150 | 10/1975 | Deutsch | 85/1.24 |
| 3,929,053 | 12/1975 | Deutsch | 84/1.24 |

*Primary Examiner*—Gene Z. Rubinson
*Assistant Examiner*—William L. Feeney
*Attorney, Agent, or Firm*—Spensley, Horn, Jubas & Lubitz

[57] ABSTRACT

An electronic musical instrument is of a type wherein musical tone waveforms are stored in a memory as their sampled amplitudes and sequentially and repetitively read out to constitute tone waveforms. A key depression brings forth key code in a digital representation. This key code is used for reading out frequency information from a frequency information memory. The frequency information is accumulated to make an address signal for reading out the waveform memory.

When a key is depressed, a counter starts counting and opens a gate for a predetermined period of time. The gate passes a code representative of an interval of a grace note with respect to the note of the depressed key (i.e. principal note) to an addition and subtraction circuit for addition or subtraction between the key code and the code representative of the interval for the grace note. Accordingly, the key code is modified and the desired grace tone is produced. Upon completion of the operation of the counter, this modification of the key code is stopped and the key code is restored to the original key code resulting in production of the principal tone. In the foregoing manner, a grace tone preceding the principal tone can be played simply by depressing a single key.

The counter is also arranged to start the counting operation upon release of the depressed key with a result that a grace tone following the principal tone can be played. Further, ornamentation called "trill" can also be produced by alternately and repetitively opening and closing the gate by means of the output of the counter.

9 Claims, 11 Drawing Figures

ELECTRONIC MUSICAL INSTRUMENT

This is a continuation of application Ser. No. 727,789, filed Sept. 29, 1976, now abandonned.

BACKGROUND OF THE INVENTION

This invention relates to an electronic musical instrument capable of automatically performing musical ornaments or grace note tones.

There is a digital type electronic musical instrument such as has been disclosed in U.S. Pat. No. 3,882,751 in which a numerical value corresponding to the frequency of a note for a depressed key is read from a frequency information memory by using a code signal (key code) of the depressed key and a muscial tone waveform memory is sequentially called by address signals which are developed by successively accumulating this numerical value. According to this type of electronic musical instrument, an attack start signal (key-on signal) and a decay start signal (key-off signal) are produced in addition to the code signal and these attack and decay start signals are used for controlling the amplitude envelope of the muscial tone.

Accordingly, the prior art electronic musical instrument can produce a musical tone corresponding to a depressed key but cannot produce any tone without depression of a corresponding key. For playing ornaments or grace notes, it is necessary in this type of instrument to depress keys very quickly following a musical score. This however requires a somewhat high playing technique which is beyond the skill of beginners.

SUMMARY OF THE INVENTION

It is an object of the invention to provide an electronic musical instrument capable of playing ornaments or grace notes simply by depressing a key for a principal note.

According to the present invention, a grace tone which is different in its tone pitch by at least a semitone is produced by modifying contents of a key code corresponding to a depressed key for a predetermined period of time and thereby designating a tone pitch of a different key. This modification is effected by adding a desired binary numerical value to a key code of a binary numerical value corresponding to a depressed key or subtracting such numerical value from the key code. A grace tone corresponding to a note coming before a principal note (hereinafter referred to as "before tone") is produced by effecting the above described modification for a predetermined period of time from generation of the attack start signal, whereas a grace tone corresponding to a note coming after a principal note (hereinafter referred to as "after tone") is produced by effecting the modification for a predetermined time from generation of the decay start signal.

It is another object of the invention to provide ornaments called "trill."

Trill can be produced by effecting the above described modification intermittently during a period of time between generation of the attack start signal and generation of the decay start signal.

DESCRIPTION OF THE PREFERRED EMBODIMENT

Figure 1:
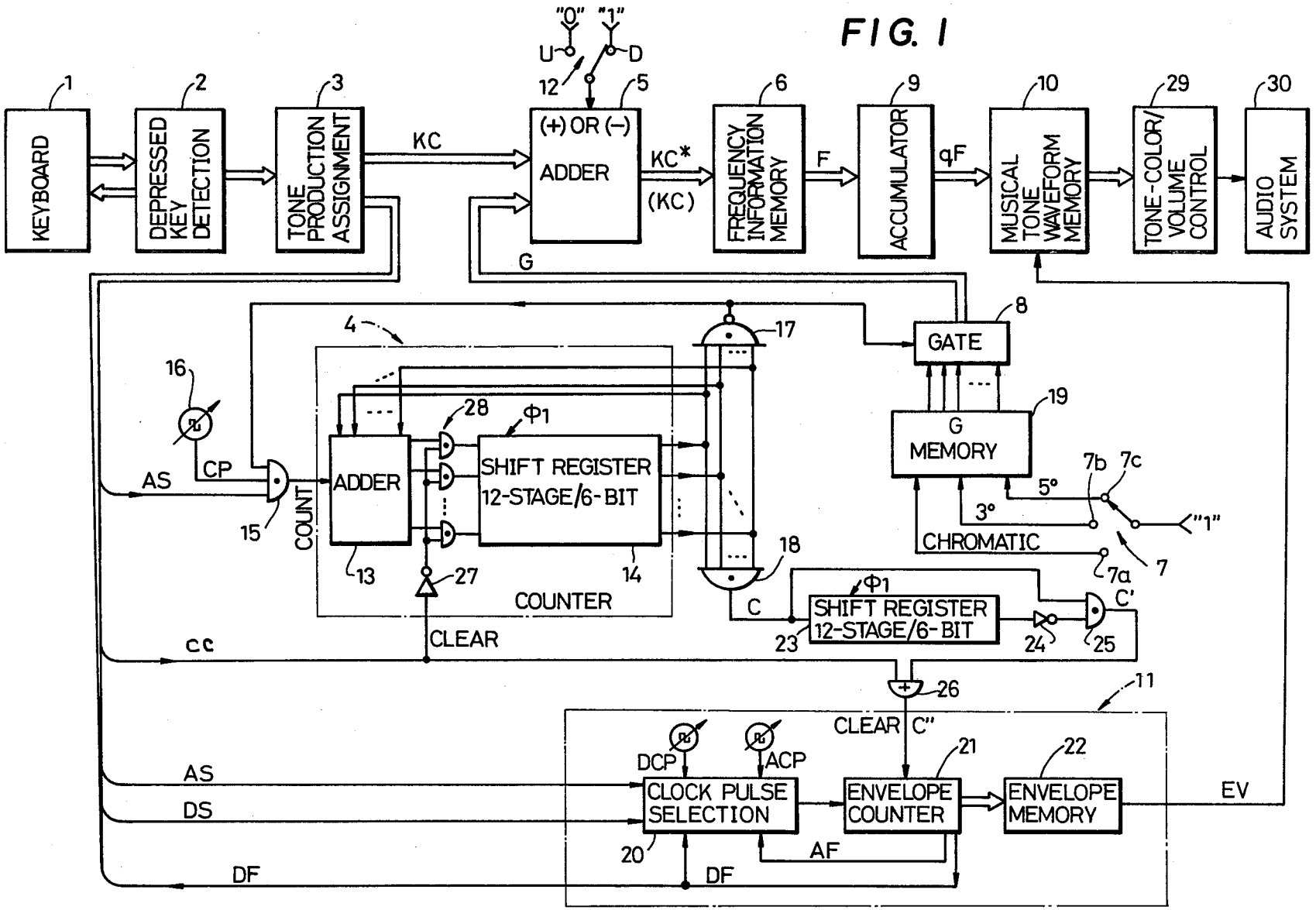
FIG. 1 is a block diagram showing an embodiment of the electronic musical instrument according to the invention.

Referrence is now made to FIG. 1, which shows one preferred embodiment of an electronic musical instrument constructed according to the present invention for carrying out the grace-note performance of appoggiature or before note.

A keyboard 1 has key switches (not shown) corresponding to respective keys (not shown) to be depressed upon playing of the instrument. A depressed key detection circuit 2 functions to detect the on or off operations of the key switches corresponding to depressed keys in the keyboard 1 and thereby to supply signals corresponding to the depressed keys to a tone production assignment or assigner circuit 3.

The tone production assignment circuit 3 receives the signals (key code) representing the depressed keys from the depressed key detection circuit 2 and assigns the keys designated by the signals to available ones of the prepared channels for tone production in a number which is a maximum available number of musical tones to be simultaneously produced (e.g., 12 channels as in the present embodiment). The tone production assigner 3 thus delivers out key codes KC representing the depressed keys through respective channels. These key codes KC indicate the key's of the principal notes to be ornamented with grace notes.

Figure 2:
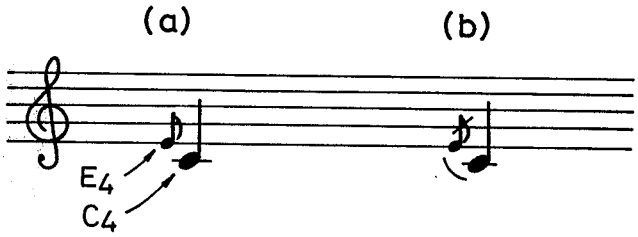
FIGS. 2(*a*) and 2(*b*) are diagrams showing examples of grace tones of "before tone" to be played by the electronic musical instrument according to the invention.

This principal note is for example, a note $C_4$ as expressed on a musical stave as shown in FIGS. 2(*a*) and 2(*b*), the former illustrating an example of a note with a long before-note (appogiatura) and the latter an example of a note with a short before-note (acciaccatura). Assume that $C_4$ is the principal note. When the key of $C_4$ is depressed in the keyboard 1, the tone production assignment circuit 3 receives the signal representing the keys $C_4$ from the depressed key detection circuit 2 and thereby delivers out a key code KC representing "$C_4$". The tone production assignment circuit 3 also delivers out an attack start signal or key-on signal AS upon depression of the key. These signal deliveries are carried out in a time sharing manner, and the associated key code and the attack start signal are delivered in synchronization with the assigned channel time.

When the key is depressed in the keyboard 1, the attack start signal AS thus delivered is applied to a counter 4, which serves the functions of setting the length of the grace-note. The counter 4 will operate upon receipt of the attack start. signal AS from the tone production assignment circuit 3. In the example shown in FIGS. 2(*a*) and 2(*b*), the grace note for the principal note $C_4$ would be a note $E_4$ which is above the principal note by an interval of a major third. The length of the grace tone to be produced will be determined or set by the counter 4. In general, the length of the grace-note may not be required to be strictly accurate.

While the counter 4 is operating in a predetermined time corresponding to the length of the grace-note, a value G representing the interval between the principal note and the grace note is applied to an adder 5, which will add the value G to the binary number of the key code KC from the tone production assignment circuit 3, as will be hereinafter described in greater detail.

Thus, the key code KC applied to the adder 5 from the tone production assigner 3 is modified by the value which is so developed as will be hereinafter described in greater detail.

Thus, the adder 5 produces a modified key code KC* which represents the key of the grace note and which is applied to a frequency information memory 6 for reading out the frequency information corresponding to the grace note.

In the arrangement of this example, the intervals between the grace tone and the principal tone can be selectively set freely by a selection switch 7. After the aforementioned predetermined time has lapsed, a gate circuit 8 will be closed so that the value G is ceased to be applied to the adder 5. Then, the adder 5 will produce the key code KC from the tone production assigner 3 as it is and applies it to the frequency information memory 6.

The frequency information memory 6 serves the functions of delivering out values F proportional to the frequencies of the notes designated by the modified key code KC and by the original key code KC respectively. A frequency information accumulator 9 and a musical tone waveform memory 10 function to provide the musical tones of the pitch of the grace note at a time and the principal note at another on the basis of the value F from the frequency information memory 6.

As was briefly described, the tone production assignment circuit 3 has storing positions defining the respective channels for storing key codes KC representative of the keys and successively delivers out the key codes stored at the respective channels in a time-sharing manner. Accordingly, in case where a plurality of keys are simultaneously depressed on the keyboards 1, the depressed keys are separately assigned to the respective channels in such a manner that the key codes KC representative of the assigned tones of the depressed keys are stored at the storing portions defining the respective channels. The respective storing portions may preferably be constituted by respective stages of a circulating shift register. For example, assume that the key codes KC specifying the respective keys in the keyboard 1 consists of a suitable number of bits, e.g. 8 bits as in the present embodiment shown in the following Table I. Assuming that the number of the entire channels is 12, there may be employed a 12-stage/8-bit shift register.

Table I

| | $K_2$ | $K_1$ |
|---|---|---|
| Upper keyboard | 0 | 1 |
| Lower keyboard | 1 | 0 |
| Pedal keyboard | 1 | 1 |

| | Key Codes KC | | | | | | | |
|---|---|---|---|---|---|---|---|---|
| | MSB Keyboard | | Block | | ISB Note | | | |
| Key Names | $K_2$ | $K_1$ | $B_2$ | $B_1$ | $N_4$ | $N_3$ | $N_2$ | $N_1$ |
| $C_2$ | . | | 0 | 0 | 0 | 0 | 0 | 0 |
| $C\#_2$ | . | | 0 | 0 | 0 | 0 | 0 | 1 |
| $D_2$ | . | | 0 | 0 | 0 | 0 | 1 | 0 |
| $D\#_2$ | . | | 0 | 0 | 0 | 0 | 1 | 1 |
| $E_2$ | . | | 0 | 0 | 0 | 1 | 0 | 0 |
| . | . | | | . | | | . | |
| . | . | | | . | | | . | |
| . | . | | | . | | | . | |
| $D_3$ | | | 0 | 0 | 1 | 1 | 1 | 0 |
| $D\#_3$ | | | 0 | 0 | 1 | 1 | 1 | 1 |
| $E_3$ | . | | 0 | 1 | 0 | 0 | 0 | 0 |
| | . | | | | | | | |
| | . | | | | | | | |
| $G_4$ | . | | 0 | 1 | 1 | 1 | 1 | 1 |
| | . | | | | | | | |
| $G\#_4$ | .. | | 1 | 0 | 0 | 0 | 0 | 0 |
| | . | | | | | | | |
| $B_5$ | . | | 1 | 0 | 1 | 1 | 1 | 1 |
| $C_6$ | . | | 1 | 1 | 0 | 0 | 0 | 0 |
| | . | | | | | | | |
| $C_7$ | | | 1 | 1 | 1 | 1 | 0 | 0 |

In the above Table I, the column of the key names includes the respective keys in the respective keyboards. The upper and lower keyboards have each 61 keys ranging from the note $C_2$ to the note $C_7$, and the pedal keyboard has less keys (usually 32 keys from $C_2$ through $G_4$). The keys in the respective keyboards are divided into plural blocks each having 16 keys. The block codes consisting of two bits $B_2$ and $B_1$ of 00 through 11 are assigned to the respective blocks sequentially from the lowest note range. The note codes consisting of four bits $N_4$ through $N_1$ of 0000 through 1111(16 kinds in all) are assigned to the respective sixteen keys in one block successively from the lowest note side. Thus, it will be understood from the foregoing description that a difference of 1 in binary notation in the key codes KC corresponds to the interval of a semitone. The note codes $N_4$ through $N_1$ ia assigned to 4 bits from the LSB at digit side of the key codes KC. The block codes $B_2$ and $B_1$ is assigned to fifth and sixth bits from the LSB of the key codes KC. The keyboard codes $K_2$ and $K_1$ representing the keyboards is assigned to the MSB and second bit from the MSB of the key codes KC in such a manner that the upper keyboard code is "01," the lower keyboard code "10," and the pedal keyboard "11."

Figure 3:
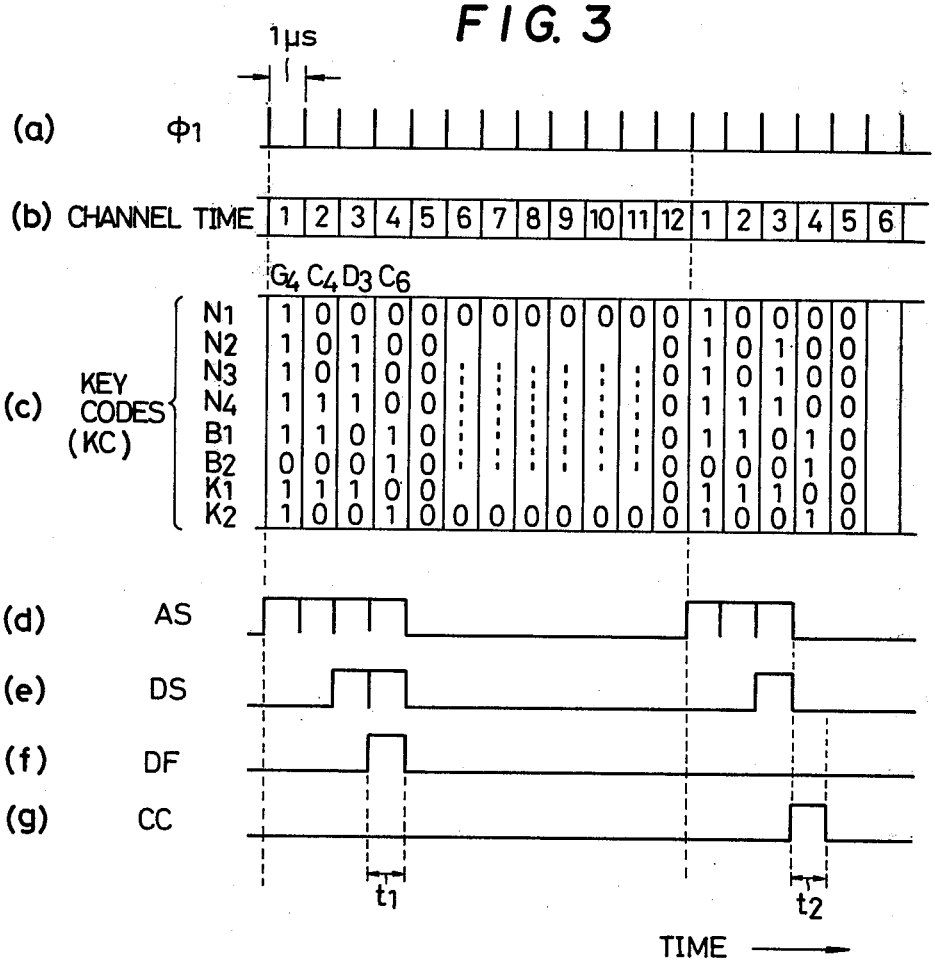
FIGS. 3(*a*) through 3(*g*) are timing chart for explaining operation of a tone production assignment circuit 3.

In order that this embodiment is capable of producing a plurality of muscial tones simultaneously, the instrument is constructed as a dynamic logic circuit system wherein the logics, the counters, the memories, etc. are commonly used in a time-sharing manner with the result that the time relation of the clock pulses for controlling the operation of the instrument is very important. FIG. 3(*a*) illustrates a graphical representation of main clock pulses $\phi_1$, which controls the time-division operations of the respective channels and which, for example, has a pulse period of 1 $\mu$s. Since this embodiment of the electronic musical instrument of the present invention has 12 channels, the respective time slots which a pulse width of 1 μs portitioned by the main clock pulses $\phi_1$ sequentially correspond to first to twelfth channels, respectively. As indicated in FIG. 3(*b*), the respective time slots will hereinbelow be referred successively to as "first to twelfth channel times." The respective channel times will appear cyclically. Accordingly, the key codes KC indicating the keys at the storing units corresponding to the channels to which the tones of the keys produced are assigned by the tone production assignment circuit 3, i.e., the key codes KC stored at the aforesaid shift register, are sequentially outputted in coincidence with the channel times in time sharing fashion. For example, assume that the musical note $G_4$ of the pedal keyboard is assigned to the first channel, the note $C_4$ of the upper keyboard to the second channel, the note $D_3$ of the upper keyboard to the third channel, the note $C_6$ of the lower keyboard to the fourth channel, and no musical note is assigned to the fifth to twelfth channels. The key codes KC produced in synchronization with the respective channel times, in a time-sharing manner from the tone production assignment circuit 3 become as indicated in FIG. 3(*c*). The outputs from the fifth to twelfth channels are all "0".

When the tone production assignment circuit 3 assigns the key code to a certain channel and delivers out the key code during depression of the key, the tone production assignment circuit 3 produces an attack start signal (key-on signal) AS designating a start of production of the tone in synchronism with the production of the key code. The tone production assignment circuit 3 also produces, upon release of the depressed key, a decay start signal (key-off signal) DS designating that the tone should be attenuated in a time sharing manner in synchronism with the channel to which the key code has been assigned. These signals AS and DS will be utilized in an envelope generation circuit 11 for controlling the amplitude of the envelope of the musical tones to control the tone production, as will be hereinbelow described in greater detail. The tone production assignment circuit 3 receives from the envelope generation circuit 11 a decay finish signal DF representing that the tone production at the corresponding channels is finished and produces a clear signal CC for clearing the various information stored in the shift registers at the stages defining the channels based on the decay finish signal DF so as to completely eliminate the tone production assignment. In the example shown in FIG. 3(*c*), assume that the keys assigned to the first and second channels remain depressed,, the keys assigned to the third and fourth channels are released and the corresponding tones are decaying. The tone production is finished at the fourth channel at the time slot $t_1$ with the decay finish signal DF being produced, and the clear signal CC is produced at the time slot $t_2$ after the delay of 12 channel times from the time slot $t_1$ as in the example shown in FIG. 3(*g*). The respective signals AS, DS, DF and CC are produced as illustrated in FIGS. 3(*d*) through 3(*g*). As the tone production assignment circuit 3 produces the clear signal CC at the time slot $t_2$, the attack start signal AS and the decay start signal DS are eliminated at the fourth channel. Simultaneously, the key code KC of the fourth channel time shown in FIG. 3(*c*) is also delated, but it is not erased from the drawings for convenience of explanation.

As will be apparent from FIG. 3, a specific channel to which the various signals KC, AS, DS and CC produced by the tone production assigner circuit 3 are assigned can be known by the channel time.

The aforementioned tone production assignment circuit 3 and the depressed key detection circuit 2 will not further be described in detail. These circuits 2 and 3 may be the depressed key detection circuit and the key assigner, respectively of the types disclosed in U.S. Pat. No. 3,882,751 entitled "Electronic musical instrument" assigned to the same assignee as in the present invention. These circuits 2 and 3 may also be constructed by the circuit arrangements other than the arrangements disclosed as described above within the spirit and the scope of the present invention, but they will not be described in any greater detail.

It is to be noted that since the key codes KC produced from the tone production assignment circuit 3 represent the depressed keys, these key codes KC may be utilized as address designation signals for reading out from a frequency information 6 a numerical information specific to the frequencies of the muscial tones of the keys represented by the key codes KC.

The frequency information memory 6 is constructed, for example, by a read only memory (ROM) for storing the frequency information F(constants) corresponding to the key codes KC of the respective keys, which read only memory serves the functions of delivering out the frequency information F stored at the addresses designated by the code upon receipt of a certain key code KC. The frequency information memory 6 is not limited only to this type of ROM but may also adopt other than this within the spirit and scope of the present invention. A frequency information accumulator 9 regularly makes cumulative addition of the frequency information F to develop successively increasing address signals for accessing memorized amplitude samples of the musical tone waveform at every predetermined constant time. The frequency information F are of digital numbers respectively proportional to the respective frequencies of the musical tones, such as, for example, binary numbers of 15 bits as disclosed in the specification of U.S. Pat. No. 3,882,751 entitled "Electronic musical instrument" assigned to the same assignee as in the present invention. This frequency information F for each frequency consists of a suitable number of bits, e.g. 15 as in the present embodiment, and represents numerals including fraction section if expressed in a decimal notation. The most significant bit of the 15 bits indicates an integer section and the rest of the bits, i.e., 14, represents a fraction section.

The value of the frequency information F may be unitarily determined at a certain constant sampling speed if the value of the frequency of the musical tone is specified. For example, assuming that when the value qF cumulatively added with the information F by the frequency information accumulator 9 becomes 64 in a decimal notation, the sampling of the one musical tone waveform is completed (where q=1, 2 . . . ) and also that this cumulative addition is achieved in every 12 μs when the entire channel times are cyclically circulated once, then the value of the frequency information F can be determined in accordance with the following equation:

$$F=12\times 64\times f\times 10^{-6}$$

where f signifies the frequencies of the musical tones. It will be understood that the frequency information F is stored in the frequency information memory 6 in accordance with the frequency f to be obtained. For example, the value F for the note $C_2$ is 0.052325 because the frequency of $C_2$ is 65.406 Hz. The values for the other notes are also determined in a similar manner.

The frequency information accumulator 9 serves the functions of cumulatively counting the frequency information F of the respective channels at a predetermined constant sampling speed, e.g., at 12 μs per respective channel times in the present embodiment for obtaining the accumulated value qF so as to advance the phase of the musical tone waveform to be read out at every sampling time (12 μs). When the accumulated value qF reaches 64 (exceeds 63) in a decimal notation, the frequency information accumulator 9 overflows to return to zero to thus complete the reading of one waveform. Since 63 in a decimal notation can be represented by 6-bit binary number, the frequency information accumulator 9 is so constructed by a counter or accumulator of 20 bits in one word wherein the first to fourteenth bits represent the fraction section and fifteenth to twentieth bits represent the integer section as to keep the accumulated result unit the accumulated value qF of the frequency information F whose fifteenth bit is the unit digit of the integer section becomes 64. It should be noted that the frequency information accumulator 9 is constructed by 12-stage/20-bit shift register together with a 20-bit adder commonly used for the respective channels in a timesharing manner.

A musical tone waveform memory 10 stores a musical tone waveform by storing sequential amplitudes at respective sample points obtained by dividing the musical tone waveform by a suitable number of sample points such as 64. The accumulated value qF produced from the frequency information accumulator 9 becomes the input for designating the addresses of the amplitude samples to be read out from the musical tone waveform memory 10. Since the number of addresses of the waveform memory 10 is 64, the data of the fifteenth to twentieth bits of 20 bits corresponding to the integer section of the accumulated value qF are adapted to be applied to the waveform memory 10 as the address input thereto. On the other hand, the data of the first to fourteenth bits corresponding to the fraction section of the accumulated value qF is merely utilized in the frequency information accumulator 9 for the cumulative addition thereof.

The adder 5 connected between the tone production assignment circuit 3 and the frequency information memory 6 functions to add to or subtract from the key codes KC a value G corresponding to the intervals between the principal note and the grace note as was heretofore described. In case of the example as shown in the Table I, since the value of the key codes KC becomes larger if the pitch of the musical tone becomes higher, the modified key codes KC* designates the grace tone having a higher frequency than that of the principal tone if the value G is added to the key code KC, whereas the modified key codes KC* will designate the grace tone having a lower frequency than that of the principal tone if the value G is subtracted from the code KC. The selection of the addition or subtraction of the adder 5 can be made by the operation of a selection switch 12. If the selection switch 12 is connected at the contact D, the signal "1" is applied to the adder 5 to cause the adder 5 to make an addition. If the selection switch 12 is connected at the contact U, the signal "0" is applied to the adder 5 to cause the adder 5 to make subtraction.

Figure 4:
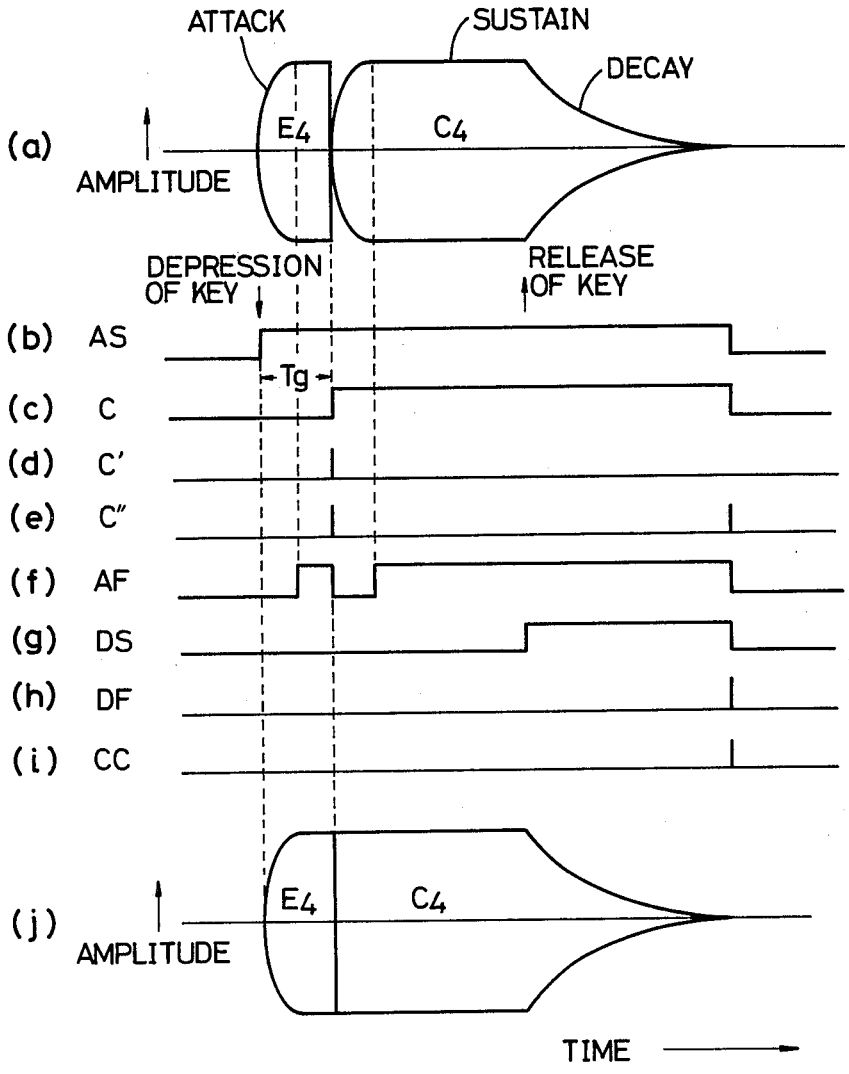
FIGS. 4(*a*) through 4(*j*) are timing charts for explaining essential circuit portions of the instrument.

The counter 4 comprises a 6-bit adder 13 and a 12-stage/6-bit shift register 14, which effect a counting operation with respect to the respective channels commonly in a time-sharing manner. The operation will now be described in more detail with respect to one channel such as the second channel. FIG. 4 illustrates graphic diagrams of the envelope of the before tone effect together with the channel time relation in term of the second channel. This operation will now be considered with the case where the principal tone is the note $C_4$ together with the grace tone $E_4$ having a pitch above $C_4$ by an, interval of major third. When the key corresponding to the note $C_4$ is depressed in the keyboard 1 and the key code representing the depressed key is assigned to the second channel by the tone production assignment circuit 3, which also produces an attack start signal AS shown in FIG. 4(*b*) at the second channel time. This attack start signal AS thus produced at the tone production assignment circuit 3 is applied to an AND circuit 15 to cause the AND circuit 15 to pass clock pulses CP from a clock pulse generator 16 to the adder 13.

This adder 13 will add the clock pulses CP to the output of the final stage of the shift register 14. Ths sum of the addition is applied from the adder 13 to the first stage of the shift register 14. The accumulated result of the clock pulses CP and the output of the shift register 14 is applied from the shift register 14 to the adder 13 in every 12 channel time to be held cyclically in such a manner that one addition is effected in every time the clock pulse CP is applied. Accordingly, the counter 4 serves the function of making cumulative addition of the clock pulse CP to the output of the shift register 14.

The total output bits of the register 14 are applied to a NAND circuit 17. The NAND circuit 17 functions to produce a signal "1" whenever even one "zero" bit exists in the counting output of the shift register 14. Therefore, the NAND circuit 17 will produce a signal "1" until the counting output of the shift register 14 in the second channel becomes a maximum value and apply it to the gate circuit 8 to enable the gate circuit 8 to gate out the value G to the adder 5, as will hereinafter be described in greater detail.

If the counting output of the shift register 14 becomes its maximum, all the bits become "1." Thus, the output of the NAND circuit 17 will become "0," which is applied to one of the input terminals of the AND circuit 15 to cause the AND circuit 15 to cease to gate out the clock pulse CP to the adder 13. Therefore, the shift register 14 will hold a maximum value in the corresponding second channel. Simultaneously, the output C of an AND circuit 18 becomes "1" as shown in FIG. 4(*c*) since the AND circuit 18 receives the output of the shift register 14, to thus effect the finishing of the grace tone. Accordingly, the gate circuit 8 will gate out the value G to the adder 5 during a predetermined constant time Tg ranging from the generation of the attack start signal AS to the generation of the grace tone finish signal C from the AND circuit 18. After the lapse of the time Tg, the output of the NAND circuit 17 becomes "0" with the result that the gate circuit 8 is closed to cease to gate out the value G to the adder 5.

It will thus be understood from the foregoing description that the binary number G corresponding to the interval between the grace tone and the principal tone is applied to the adder 5 during the constant time Tg when the gate circuit 8 is enabled. The value G is read out from a G memory (read-only memory) 19 provided for storing a plurality of values corresponding to the interval of the various degrees in advance and is thus supplied to the gate circuit 8. This read-only memory 19 serves the functions of reading out the value G in response to the set position of the interval selection switch 7. If the switch 7 is connected at the contact *7a*, the G memory 19 will deliver out a G value corresponding to the interval of a semitone. This is "1" in the case shown in the Table I. If the switch 7 is connected at the contact *7b*, the G memory 19 will deliver out a G value corresponding to the interval of major third. Then, if the switch 7 is connected at the contact *7c*, the G memory 19 will deliver out a G value corresponding to the interval of perfect fifth. For example, the value G of the interval of major third is 4 in decimal notation, whereas the G value corresponding t the interval of perfect fifth is 7 in decimal notation. In a case where the example shown in FIG. 2 is of the interval of major third, if the switch 7 is connected at the contact *7b*, the interval value G being 4 (or "100" in binary notation) will be applied to the adder 5.

In the example shown in FIG. 2, the principal tone is the note $C_4$, and the key code KC representing the note $C_4$ applied to the adder 5 is "011000" excluding the keyboard code $K_2$, $K_1$. The value G "100" is added to the aforesaid key code KC upon connection of the selection switch 12 to the contact D. As a result, the modified key code KC* being "011100" is applied to the frequency information memory 6 during the predetermined constant time Tg. As clear from the Table I, since the modified key code KC* represents the note $E_4$, the frequency information F corresponding to the note $E_4$ will be read out from the frequency information memory 6, and the musical tone waveform of the pitch of the note $E_4$ will also be read out from the musical tone waveform memory 10.

Thus, it will be understood from the foregoing description that the musical tone is produced by the pitch of the grace tone of $E_4$ in this example during the predetermined time Tg from the initial depression of the key. After the lapse of the time Tg, the value G becomes "0". Accordingly, the key code KC is applied to the adder 5 as it is, and the musical tone determined by the key code KC will be produced at the pitch of the principal note of $C_4$ from the musical tone waveform memory 10.

It is to be noted that the duration time Tg of the grace tone can be freely set under the variable control of the frequency of the clock pulse CP applied from the clock pulse generator 16. Assuming that the period of the clock pulse CP is signified by a reference character 7, since the shift register 14 is of the type having 12-stage/6-bit, the time Tg is $$Tg = \leftarrow 12 \times 2^6 \times \tau(s)$$

According to the present invention, the attack start signal AS produced from the tone production assignment circuit 3 is also applied to a clock pulse selection circuit 20 in the envelope generation circuit 11. Attack clock pulses ACP is applied from an attack clock pulse generator to the clock pulse selection circuit 20. This clock pulse selection circuit 20 serves the functions of selecting the attack clock pulse ACP applied from the attack clock pulse generator and applying it to an envelope counter 21 upon receipt of the attack start signal AS from the tone production assignment circuit 3, and thus driving the envelope counter 21 to effect a counting operation of the envelope counter 21.

The envelope counter 21 will thereupon produce an output as will be hereinafter described in greater detail. The output of the envelope counter 21 is thus applied to an envelope memory 22 to cause the envelope memory 22 to read out an envelope amplitude EV of the attack portion of the envelope. The envelope memory 22 thus produces the envelope waveform EV which in turn is applied to the musical tone waveform memory 10 to control the amplitude of the musical tone waveform produced by the musical tone waveform memory 10.

As shown in FIG. 4(*a*), the attack envelope is imparted to the grace tone $E_4$ as the before tone of the principal tone $C_4$. When this attack portion is finished, an attack finish signal AF as shown in FIG. 4(*f*) is produced by the envelope counter 21, as will be hereinbelow described in greater detail. This attack finish signal AF produced by the envelope counter 21 is applied to the clock pulse selection circuit 20 to cause the clock pulse selection circuit 20 to cease to receive the attack clock pulse ACP from the attack clock pulse generator. Thus, when the application of the attack clock pulse ACP to the clock pulse selection circuit 20 is ceased, the clock pulse selection circuit 20 will stop applying the output thereof to the envelope counter 21 to cease the counting operation of the envelope counter 21. Consequently, the envelope counter 21 remains at its heretofore counted value and applies the same value to the envelope memory 22 to cause the envelope memory 22 to deliver the value of that point of the envelope waveform EV to the musical tone waveform memory 10. Thus, the output amplitude of the musical tone waveform produced from the musical tone waveform memory 10 will be maintained at a constant sustain level.

When the duration time Tg of the grace tone is finished, a grace tone finish signal C will be produced from the AND circuit 18, as shown in FIG. 4(*c*), which operation was as has been described heretofore. This grace tone finish signal C is applied to a 12-stage/1-bit shift register 23 and is delayed by 12 channel times in the shift register 23. The delayed grace tone finish signal C thus produced from the shift register 23 is then inverted by an inverter 24 and the inverted grace tone finish signal C is applied to one of the input terminals of an AND circuit 25. This grace tone finish signal C is substantially differentiated by the AND circuit 25, which produces thus differentiated grace tone finish signal C′ being "1" as illustrated in FIG. 4(*d*). This differentiated grace tone finish signal C′ produced from the AND circuit 25 is applied through an OR circuit 26 to the reset input C″ of the envelope counter 21 as indicated in FIG. 4(*e*) so as to reset the envelope counter 21. Accordingly, as shown in FIG. 4(*a*), the amplitude of the attack portion of the grace tone $E_4$ becomes "0".

When the reset input C″ applied from the AND circuit 25 is applied to the envelope counter 21, the envelope counter 21 ceases to produce the attack finish signal AF as shown in FIG. 4(*f*), and thus to cease to apply the attack finish signal AF back to the clock pulse selection circuit 20. Consequently, the clock pulse selection circuit 20 will again receives the attack clock pulse ACP from the attack clock pulse generator with the reception of the attack start signal AS from the tone production assignment circuit 3 and awill then apply the attack clock pulse ACP to the envelope counter 21. Accordingly, the envelope counter 21 starts its counting operation from the initial state and the output thereof is then applied to the envelope memory 22 to cause the envelope memory 22 to read out the amplitude EV of the envelope of the attack portion of the principal tone and to thus provide an attack portion or characteristic for the rise portion of the principal tone $C_4$ as illustrated in FIG. 4(*a*).

When the key of the principal tone $C_4$ thus depressed is released in the keyboard 1, the decay start signal DS is produced by the tone production assignment circuit 3 as indicated in FIG. 4(*g*) in the manner as was heretofore described. The decay start signal DS thus produced by the tone production assigner circuit 3 is applied to the clock pulse selection circuit 20 on the envelope generation circuit 11.

According to the present invention, when the decay start signal DS is thus applied to the clock pulse selection circuit 20, the clock pulse selection circuit 20 serves the functions of selecting decay clock pulse DCP applied from a decay clock pulse generator and applying it to the envelope counter 21 and thus causing the envelope counter 21 to make a counting operation of the decay clock pulses DCP applied from the clock pulse selection circuit 20. When the decay clock pulses DCP are applied to the envelope counter 21, the envelope counter 21 causes the envelope memory 22 to read out the envelope amplitude of the decay portion of the principal tone $C_4$ to thus fall the decay portion of the principal tone $C_4$ as indicated in FIG. 4(*a*).

When this decay portion of the fundamental tone $C_4$ is finished, a decay finish signal DF as indicated in FIG. 4(*h*) is produced from the envelope counter 21. This decay finish signal DF thus produced by the envelope counter 21 is applied to the tone production assigner 3, and the tone production assigner 3 will then produce, upon receipt of the decay finish signal DF from the envelope counter 21, a clear signal CC as indicated in FIG. 4(*i*).

This clear signal CC thus produced by the tone production assignment circuit 3 is inverted by an inverter 27 in the counter 4 (this counter 4 is for providing the length of the grace tone) and is then applied to the respective one of the input terminals of AND gate circuits 28 connected from the adder 13 to the shift register 14 in the counter 4 to disenable the respective AND gate circuit 28 which thereupon cease to gate out the output of the adder 13 to the shift register 14 so as to reset the maximum value held in the corresponding channel of the counter 4.

When the clear signal CC applied from the tone production assigner 3 is thus applied to the counter 4, the maximum counting output of the shift register 14 is reset in the corresponding channel with the result that the output C of the AND circuit 18 becomes "0" as illustrated in FIG. 4(*c*).

The clear signal CC thus produced by the tone production assignment circuit 3 is also applied through the OR circuit 26 to the reset input C″ of the envelope counter 21 so as to reset the envelope counter 21. In this way, the envelope of the grace tone $E_4$ and the principal tone $C_4$ are so controlled as to provide the envelopes as illustrated in FIG. 4(*b*).

The foregoing description has been made with respect to a case wherein the grace tone of and the principal tone the envelopes as shown in FIG. 4(*a*) are produced, i.e. the notes as indicated in FIG. 2(*a*) are played by the electronic musical instrument.

Another preferred embodiment of the arrangement of the electronic musical instrument according to the present invention will provide a performance as expressed designated in FIG. 2(*b*) with the notes of the grace tone $E_4$ and the principal tone $C_4$ which are connected with a slur. In this case an attack portion is provided only for the grace tone $E_4$ of the initial tone production and the pitch is merely changed from the grace tone $E_4$ to the principal tone $C_4$ while maintaining the envelope at the sustain level as shown in FIG. 4(*j*) without providing a particular attack portions for the principal tone separately as in the previous embodiment. In order to provide such modified envelope, the circuit arrangement including the shift register 23, the inverter 24, and the OR circuit 26 for resetting the envelope counter 21 with the grace tone finish signal C is unnecessary.

The musical tone waveform signal produced from the musical tone waveform memory 10 is applied to a tone-color/volume control circuit 29 for controlling the tone-color and the volume of the musical tone and is then controlled in the tone-color and the volume thereof. The output of the tone-color/volume control circuit 29 thus controlled is then applied to an audio system 30, which produces the musical tones therefrom.

The foregoing description has been made with respect to a case where the analog envelope amplitude EV is directly applied to the musical tone waveform memory 10 for directly controlling the amplitude of the musical tone waveform read out from the waveform memory 10. This musical tone waveform memory 10 has used the memory of the arrangement disclosed in the specification of U.S. Pat. No. 3,890,602 entitled "Semiconductor waveform memory" assigned to the same assignee as in the present invention, and thus controls the amplitude voltage of the musical tone waveform samples produced in analog voltage in response to the envelope amplitude or waveform EV. Therefore, assuming that another read-only memory and the like is used as the musical tone waveform memory 10, a weighting circuit (not shown) will be preferably provided separately for controlling the amplitude of the musical tone waveform in response to the envelope waveform EV therein.

Figure 5:
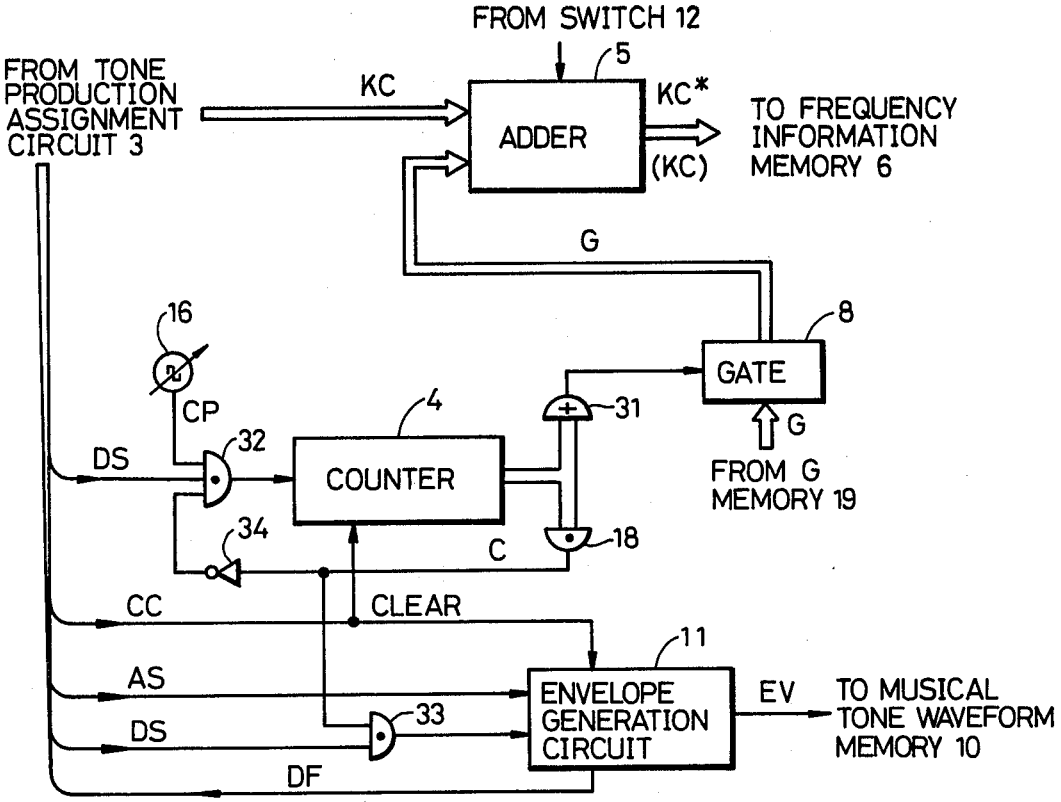
FIG. 5 is a block diagram showing an essential portion of another embodiment of the instrument according to the invention.

FIG. 5 shows a further preferred example of the electronic musical instrument constructed in accordance with the present invention for achieving the grace note of after note performance, wherein the name component parts as those shown in FIG. 1 are illustrated by the same reference numerals and characters and description thereof is omitted.

Figure 6:
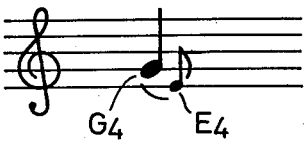
FIG. 6 is a diagram showing an example of a grace tone of "after tone" to be played by the instrument according to the invention.

When the key corresponding to the principal note such as the note $G_4$ in the keyboard 1 as shown on a musical stave in FIG. 6 is depressed, the musical tone is produced with the pitch of the principal note $G_4$ having an envelope shown in FIG. 7(*a*), as will be hereinafter described in greater detail. When the key of the principal note $G_4$ is released, the tone pitch is changed to the grace note $E_4$ while maintaining the envelope of the initial principal note at the sustain level as shown in FIG. 7(*a*).

Upon depression of the key of the principal note $G_4$, the attack start signal AS produced from the tone production assignment circuit 3 is applied to the envelope generation circuit 11 but is not applied to the counter 4. Therefore, the counter 4 does not make a counting operation nor produces counted output but produces "0" output. The "0" output is also produced through an OR circuit 31. Thus, this "0" output from the OR circuit 31 is applied to the input of the gate circuit 8 with the result that the interval value G for the grace tone applied from the G memory 19 to the gate circuit 8 is not gated out.

Thus, the interval value G from the gate circuit 8 is not applied to the adder 5. Therefore, the adder 5 will apply the key code KC applied from the tone production assignment circuit 3 to the frequency information memory 6 as it is.

Figure 7:
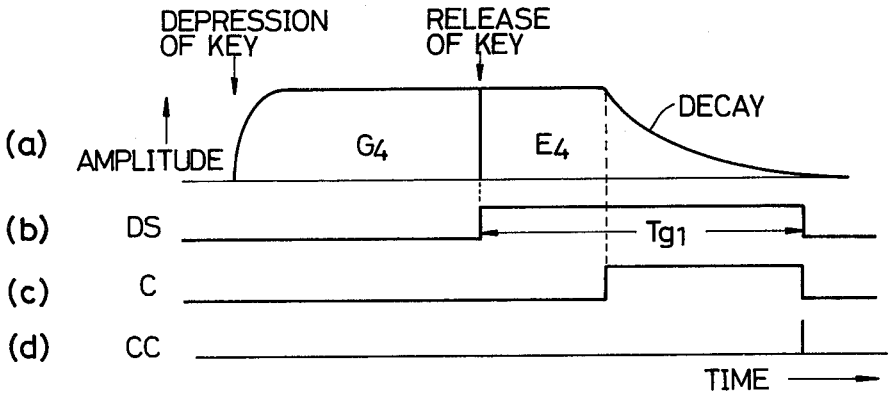
FIGS. 7(*a*) through 7(*d*) are timing charts for explaining operation of the instrument shown in FIG. 5.

When the key thus depressed is released, a decay start signal DS is produced from the tone production assignment circuit 3 as indicated in FIG. 7(*b*). This decay start signal DS is applied to an AND circuit 32 to cause the AND circuit 32 to pass the clock pulse CP to the counter 4.

The counter 4 will make a counting operation upon receipt of the clock pulse CP from the AND circuit 32 so that one of the outputs of the counter 4 becomes "1", and thus produces "1" output to the OR circuit 31. The output "1" produced from the OR circuit 31 is applied to the input of the gate circuit 8 to cause the gate circuit 8 to gate out the interval value G applied from the G memory 19 and set by the switch 7 in FIG. 1 to the adder 5.

In this embodiment, the grace tone $E_4$ is lower than the principal tone $G_4$ as shown in FIG. 6. Accordingly, in order to play such performance of the grace tone, the selection switch 12 in FIG. 1 is connected at the contact U to cause the adder 5 to make subtraction so as to subtract the value G (numerical 3 in this case) applied from the G memory 19 to the adder 5 from the key code KC applied from the tone production assignment circuit 3. The adder 5 will thus produce an modified key code KC* (KC - G), which is applied to the frequency information memory 6. Since the output C of the AND circuit 18 is "0" as indicated in FIG. 7(*c*) before the count of the counter reaches a maximum value, an AND circuit 33 is not enabled and the decay start signal DS applied from the tone production assigner 3 to one of the input terminals of the AND circuit 33 is not passed to the envelope generation circuit 11. Thus, the sustain level of the principal tone $G_4$ is maintained while the pitch of the principal tone $G_4$ is changed to the grace tone $E_4$ with the amplitude of the sustain level remaining unchanged as shown in FIG. 7(*a*).

As the counter 4 continues to make the counting operation and the counted value of the counter 4 becomes a maximum value, the output C of the AND circuit 18 becomes "1." The output C of the AND circuit 18 is inverted by an inverter 34, and the inverted output from the inverter 34 is applied to one of the input terminals of the AND circuit 32 to disenable the AND circuit 32 and thus to hold the counted value of the counter 4. Simultaneously, the output C being "1" from the AND circuit 18 is also applied to one of the input terminals of the AND circuit 33 to cause the AND circuit 33 to gate out the decay start signal DS to the envelope generation circuit 11.

As was described with respect to the grace tone of before note, when the decay start signal DS is applied to the envelope generation circuit 11 and more particularly to the clock pulse selection circuit 20 in the envelope generation circuit 11 in FIG. 1, the clock pulse selection circuit 20 functions to select decay clock pulse DCP from the decay clock pulse generator therein and to apply it to the envelope counter 21 in the envelope generation circuit 11 in FIG. 1 to cause the envelope counter 21 to make a counting operation of the decay clock pulses DCP and to also cause the envelope memory 22 in the envelope generation circuit 11 to read out the envelope amplitude of the decay portion of the grace tone $E_4$ and thereby form the decay portion of the grace tone of the after note as illustrated in FIG. 7(*a*).

When this decay portion of the grace tone $E_4$ is completed, a decay finish signal DF is produced from the envelope counter 21 in the envelope generation circuit 11 in the same manner as in the arrangement shown in FIG. 1. This decay finish signal DF thus produced from the envelope counter 21 is applied to the tone production assignment circuit 3, and the tone production assigner 3 will produce a clear signal CC as indicated in FIG. 7(*d*).

This clear signal CC thus produced from the tone production assigner 3 is applied to the counter 4 to cause the counter 4 to be reset. Thus, the counter 4 will produce its output "0", which is applied through the OR circuit 31 to the gate circuit 8 to cause the gate circuit 8 to cease to gate out the interval value G from the G memory 19 to the adder 5. The clear signal CC thus produced from the tone production assigner 3 is also applied to the envelope counter 21 in the envelope generation circuit 11 as shown in FIG. 1 to cause the envelope counter 21 to be reset.

In the above embodiment, the duration time $Tg_1$ shown in FIG. 7(*b*) of the grace tone of the after note may suitable be controlled by means of the clock pulses CP and the decay clock pulse DCP.

Figure 8:
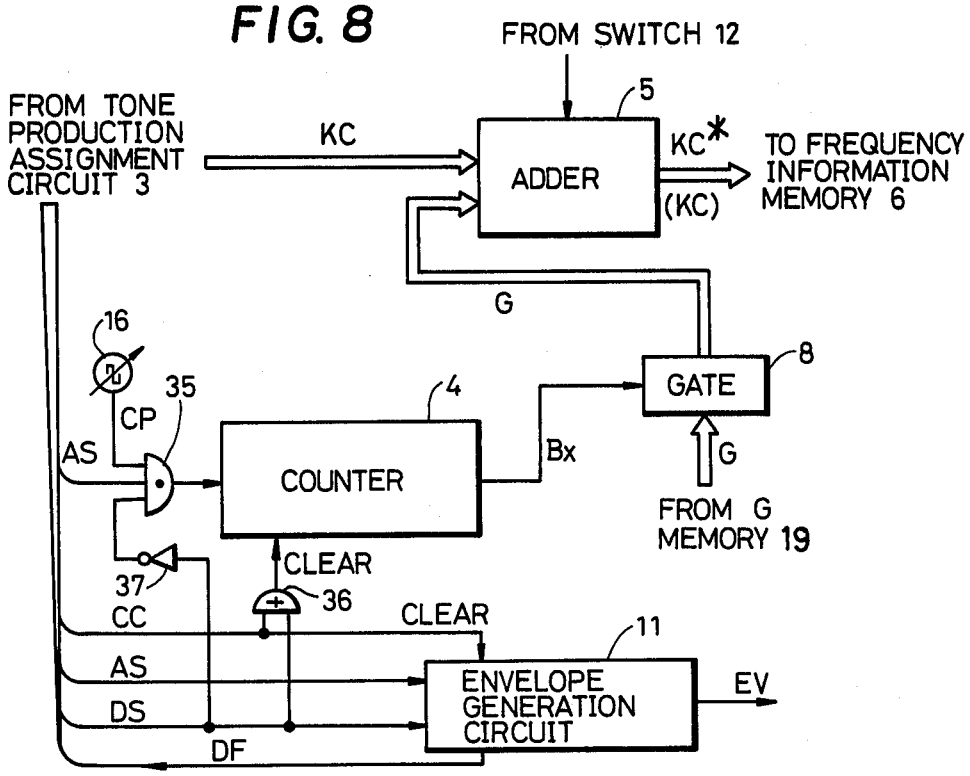
FIG. 8 is a block diagram showing an essential portion of still another embodiment of the instrument according to the invention.

FIG. 8 illustrates still another preferred embodiment of the electronic musical instrument for achieving a trill performance, wherein the same component parts as those shown in FIG. 1 are indicated by the same reference numerals and characters and description thereof is omitted.

Figure 9:
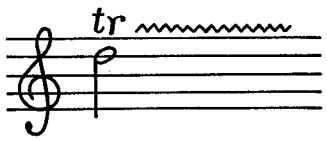
FIGS. 9(*a*) and 9(*b*) are diagrams showing examples of a trill to be played by the circuit showing in FIG. 8.
Figure 9:
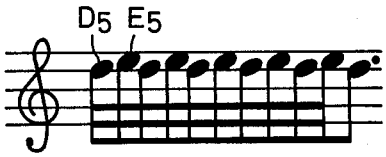

The trill is expressed on a musical stave shown in FIG. 9(*a*), and this is accomplished by repetitively and alternately playing a principal tone such as $D_5$ and a grace tone such as $E_5$ as illustrated in FIG. 9(*b*).

Figure 10:
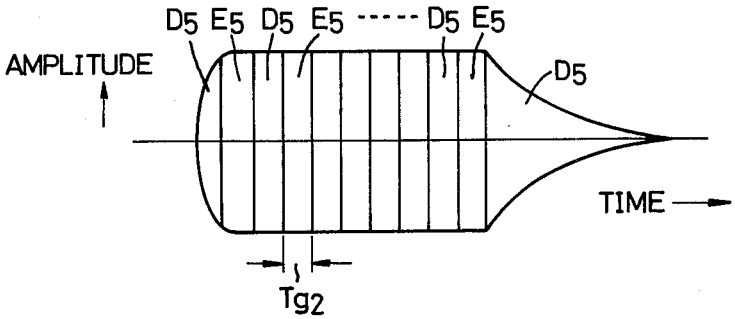
FIG. 10 is a graphical diagram showing an example of a trill produced by the circuit showin in FIG. 8.

When the key of the principal note such as $D_5$ is depressed in the keyboard 1, the musical tones are so produced as to alternately and repetitively sound the principal tone such as $D_5$ and the grace tone such as $E_5$ with an envelope shown in FIG. 10 having an attack portion at the initial tone production a sustain portion changing repetitively the principal and the grace tones while maintaining the sustain level and a decay portion of the principal tone falling gradually.

Upon depression of the key of the principal note such as $D_5$, the attack start signal AS produced from the tone production assignment circuit 3 is applied to an AND circuit 35 to cause the AND circuit 35 to pass the clock pulses CP from the clock pulse generator 16 to the counter 4.

Among the counting outputs of the counter 4, only one bit signal of a desired bit Bx is taken out and applied to the gate 8. If, for example, the bit Bx is the third bit, and the period of the clock pulses CP is represented by $\tau$, the signal "1" of the bit Bx is repetitively produced at the period of $$Tg_2 = 12 \times 2^3 \times \tau \ (s)$$

Therefore, the gate circuit 8 is repetitively closed and opened at the period of $Tg_2$. Accordingly, the gate circuit 8 will repetitively pass and cease to gate out the interval value G from the G memory 19 in FIG. 1 to the adder 5. It will be understood from the foregoing description that the key codes KC applied from the tone production assignment circuit 3 to the adder are alternately and repetitively modified, upon repetitive an-off receipt of the interval value G from the gate circuit 8, to the key code KC*. Thus, the adder 5 will apply repetitively and alternately the original key code KC and the dodified key code KC* to the frequency information memory 6.

In the example shown in FIG. 9, since the interval between the principal note such as $D_5$ and the grace note such as $E_5$ is major second, a contact for major second is also provided for the switch 7 (in FIG. 1).

As has previously been described, the principal tone $D_5$ and the grace tone $E_5$ are alternately and repetitively produced as shown by the envelope of FIG. 10 having the attack portion and the sustain portion while maintaining the sustain level successively.

When the key thus depressed corresponding to the principal tone $D_5$ is released in the keyboard 1, the decay decay start signal DS produced by the tone production assignment 3 is applied to the reset input of the counter 4 via an OR circuit 36 so as to reset the counter 4.

The decay start signal DS is also applied to an inverter 37 and the inverted decay start signal is applied to one of the input terminals of the AND circuit 35 to disenable the AND circuit 35. Thus, the counter 4 will cease to apply the bit signal Bx to the gate circuit 8.

With regard to the decay start signal DS which is also applied to the envelope generation circuit 11, a similar operation is performed to that in the previous embodiments to thus form the decay portion of the principal tone $D_5$.

The foregoing description has been made with respect to a case where the counter 4 is used for supplying the repetitive bit signal Bx to the gate 8. It will be understood from the foregoing description that instead of the counter 4, 1-bit flip-flop may also be used for supplying the signal Bx to the gate 8.

In the above described embodiment, the repetitive duration time $Tg_2$ of the trill performance may freely be controlled by varying the frequency of the clock pulse CP.

What is claimed is:

1. An electronic musical instrument of a type having a grace tone effect, comprising:

keys, means for generating, in response to depression of a selected one of said keys, a key code signal containing information designating a musical note corresponding to the selected key, a frequency information memory containing a set of frequency information numbers that are proportional to the frequencies of musical tones, access means, receiving a key code signal from said means for generating, for reading out from said frequency information memory a frequency information number corresponding to the received key code signal, means for producing a musical tone for a depressed key on the basis of the frequency information number read from said frequency information memory and corresponding to the key code signal for a selected key, and means, actuated at a transition between the depressed and released condition of said selected key, for changing said key code signal for a predetermined period of time and by a preselected fixed amount independent of the fundamental frequency of the produced tone, the resultant changed key code signal being provided to said access means instead of the unchanged key code signal, said instrument thereby producing a grace tone.

2. An electronic musical instrument of a type having a grace tone effect, comprising:

keys, means for generating, in response to depression of a selected one of said keys, a key code signal containing information designating a musical note corresponding to the selected key, means for producing a musical tone for a depressed key on the basis of the key code signal for that selected key, and means, actuated at a transition between the depressed and released condition of said selected key, for changing said key code signal for a predetermined period of time and by a preselected fixed amount, thereby producing a grace tone, said means for changing the key code signal comprising:

a memory storing a plurality of codes corresponding to various intervals;

means for selectively designating a code to be read from said memory, thereby preselecting said fixed amount of change;

gate means connected to the output terminal of said memory;

gate control means for controlling opening of said gate means for a predetermined period of time in response to a transition between the depressed and released condition of said selected key;

switch means settable to a first position when said grace note is to have a higher frequency than the note corresponding to the selected key and settable to a second position when said grace note is to have a lower frequency, and addition and subtraction means for adding said code from said gate means to said key code when said switch means is set to said first position and for subtracting said code from said key code when said switch means is set to said second position.

3. An electronic musical instrument as defined in claim 2 wherein said gate control means open said gate means only during a predetermined period of time from depression of the key.

4. An electronic musical instrument as defined in claims 2 wherein said gate control means open said gate means only during a predetermined period of time from release of the key.

5. An electronic musical instrument as defined in claim 2 wherein said gate control means intermittently open said gate plural times during a period of time between depression and release of the key.

6. In an electronic musical instrument of the type having keys, means for providing a key code in response to depression of a selected key, said key code corresponding to said selected key, a frequency information memory storing a set of frequency numbers proportional to the frequencies of musical notes, a tone generator for generating a musical tone having a frequency established by such a frequency number, and accessing means for accessing from said frequency information memory a frequency number associated with a key code provided thereto and for supplying said accessed frequency number to said tone generator, the improvement for providing a grace note wherein:

said key codes are in binary form and are selected so that a difference of a certain fixed binary value corresponds to a semitone of the generated tone, said improvement comprising:

a grace note interval selection means for selecting the interval by which the provided grace note differs from the frequency of said corresponding musical note, said interval selection means providing a binary signal of fixed binary value indicative of the selected interval, said fixed binary value being independent of the fundamental frequency of the generated tone, and combining means, operative for a certain time duration upon occurrence of a transition between the depressed and released condition of said selected key, for combining the key code for the selected key with the selected interval indicative binary signal of fixed binary value, the resultant combined key code and interval indicative binary signal being provided to said accessing means, the resultant associated frequency number accessed from said frequency information memory and supplied to said tone generator causing generation of said grace note.

7. An electronic musical instrument according to claim 6 wherein said difference of certain binary value corresponding to a semitone is binary '1', and wherein said grace note selection means facilitates selection of a binary signal having a value binary '1' for an interval of a semitone, having a value binary '100' for an interval of a major third, and having a value binary '111' for an interval of a perfect fifth.

8. An electronic musical instrument according to claim 6 wherein said instrument further includes;

envelope generator means, cooperating with said tone generator, for providing said generated tone with an amplitude envelope having an attack portion beginning when said key is depressed and a decay portion beginning when said key is released, said improvement further comprising;

envelope modification means for repeating said envelope attack portion when said grace note is produced in response to key depression, and for delaying said envelope decay portion by a preselected time interval when said grace note is produced in response to key release.

9. An electronic musical instrument according to claim 6 wherein said certain time duration is the entire time between depression and release of said selected key, and wherein a trill effect is produced, said improvement further comprising:

trill means for periodically alternately enabling and disabling said combining means so that the unmodified key code for said selected note and said resultant combined key code and interval indicative binary signal are alternately provided to said accessing means for use thereby.

* * * * *